US005156529A

United States Patent [19]

Ferleger et al.

[11] Patent Number: 5,156,529

[45] Date of Patent: Oct. 20, 1992

[54] INTEGRAL SHROUD BLADE DESIGN

[75] Inventors: Jurek Ferleger, Longwood; Harry F. Martin, Altamonte Springs, both of Fla.

[73] Assignee: Westinghouse Electric Corp., Pittsburgh, Pa.

[21] Appl. No.: 676,413

[22] Filed: Mar. 28, 1991

[51] Int. Cl.[5] ..... F01D 5/16

[52] U.S. Cl. ..... 416/190; 416/191; 416/203; 416/500; 29/889.2

[58] Field of Search ..... 416/179, 189, 190, 191, 416/194, 195, 203, 500; 29/889, 889.2, 889.21

[56] References Cited

U.S. PATENT DOCUMENTS 2,430,140 11/1947 Phelan et al. ..... 416/190
3,649,133 3/1972 Wagner ..... 416/190
4,097,192 6/1978 Kulina ..... 416/500
4,699,569 10/1987 Gloor ..... 416/190
4,767,273 8/1988 Partington ..... 416/190
4,776,764 10/1988 Ortolano ..... 416/190
4,878,810 11/1989 Evans ..... 416/500

*Primary Examiner*—Edward K. Look
*Assistant Examiner*—James A. Larson
*Attorney, Agent, or Firm*—K. Bach

[57] ABSTRACT

An integral shroud blade comprising a root portion for mounting the blade in a row on a turbine rotor; a platform portion; an airfoil portion extending upwardly from the platform portion and having a leading edge, a trailing edge, and a tip; a shroud formed on the tip of the airfoil portion and having two opposite tangential side surfaces and a top surface; and at least one pair of holes extending into the shroud, each of the two tangential sides having one hole of each pair being formed therein.

6 Claims, 3 Drawing Sheets

INTEGRAL SHROUD BLADE DESIGN

BACKGROUND OF THE INVENTION

1. Field of the Invention

The present invention relates generally to the field of turbine blade design and fabrication and, more specifically, to an improved side-entry integral shroud blade.

2. Description of the Related Art

A typical side-entry rotary turbine blade has a root portion, a platform portion, and an airfoil portion. For shrouded blades, the tip of the airfoil portion is connected to a shroud through a tenon, or the shroud may be integrally formed at the tip.

A conventional, integral shroud blade is illustrated in FIG. 1 and is generally referred to by the numeral 10. The blade 10 has a root portion 12, a platform portion 14, an airfoil portion 16 including a leading edge 18 and a trailing edge 20, and an integral shroud 22. Conventionally, the shroud 22 is substantially rectangular and functions as a rotating seal and improves blade vibratory characteristics due to shroud snubbing. As is illustrated in FIG. 1, a shroud lightening groove 24 is formed to place the center of gravity above the centroid of the root portion, thus minimizing eccentric stresses introduced during blade rotation. The shroud 22 is also centered in the tangential direction.

Control of the shroud center of gravity in the tangential direction has been difficult with the design illustrated in FIG. 1, incorporating a lightening groove.

SUMMARY OF THE INVENTION

An object of the present invention is to provide an integral shroud blade having means for controlling the shroud center of gravity in the tangential direction.

Another object of the present invention is to provide an integral shroud blade capable of having a reduced trailing edge overhang without increasing root/foil eccentric stresses, thus minimizing steam leakage path between the airfoil portion outer-diameter trailing edge region and the shroud of the adjacent blade.

Another object of the present invention is to provide an integral shroud blade capable of having frequency changes between alternate blades to thereby increase shroud snubbing and reduce vibratory stresses.

Another object of the present invention is to provide an integral shroud blade capable of achieving mix-tuning of alternate integral shroud blades to reduce the probability of blade failure resulting from unstalled flutter (wherein a row of blades vibrate at a frequency close to their natural frequency due to aerodynamic negative damping).

Still another object of the present invention is to provide an integral shroud blade capable of having improved blade sealing.

These and other objects of the invention are met by providing an integral shroud blade which includes a root portion for mounting the blade in a row on a turbine rotor, a platform portion, an airfoil portion extending upwardly from the platform portion and having a leading edge, a trailing edge, and a tip, and a shroud formed on the tip of the airfoil portion and having two opposite tangential side surfaces and a top surface, and at least one pair of holes, one hole of each pair being formed in each of the tangential sides of the shroud.

Control of the shroud center of gravity in the tangential direction can be achieved by offsetting the symmetry of the two holes of each pair, for example, by machining a deeper hole on the concave surface side of the blade than on the opposite side.

These and other features and advantages of the integral shroud blade design of the present invention will become more apparent with reference to the following detailed description and drawings.

BRIEF DESCRIPTION OF THE DRAWINGS

FIG. 2(*a*) is an end view of a shroud according to the present invention, showing a variation technique of reducing mass in the shroud with offset symmetry grooves;

DETAILED DESCRIPTION OF THE PREFERRED EMBODIMENTS

Figure 1:
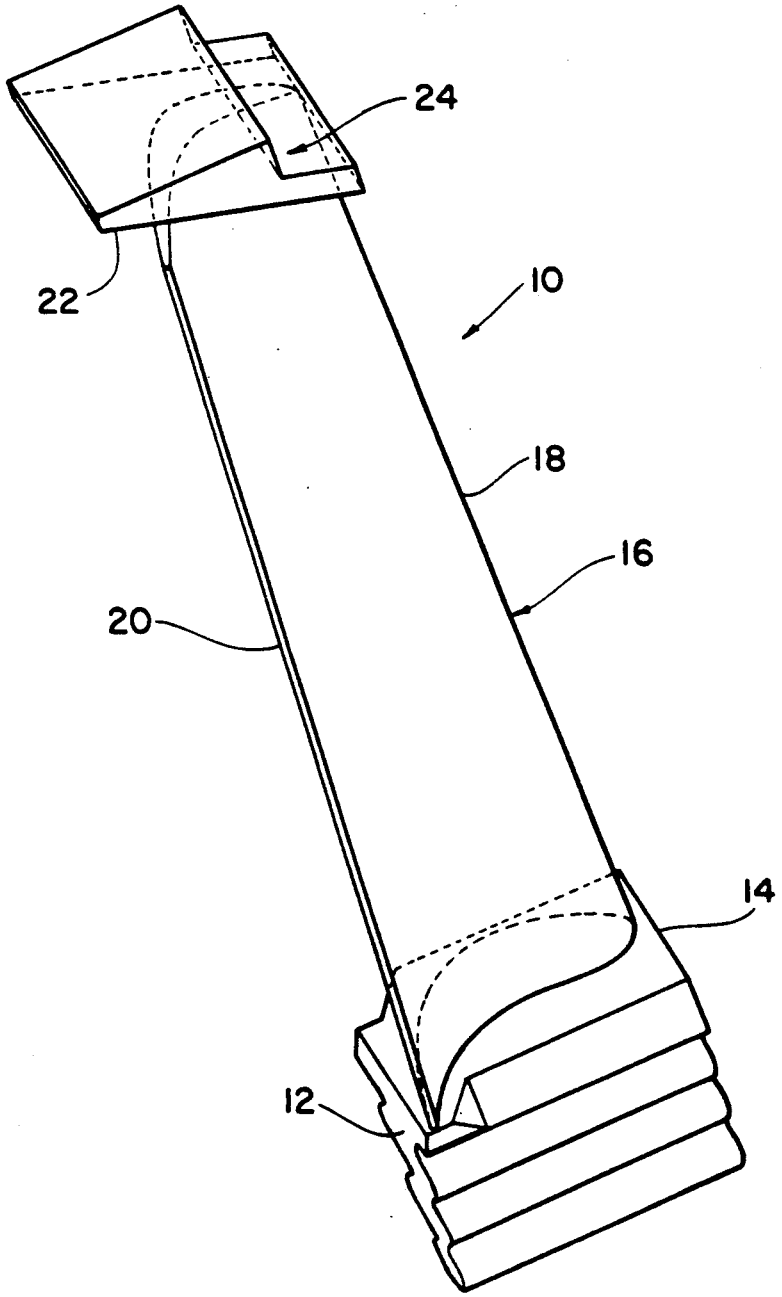
FIG. 1 (PRIOR ART)
FIG. 1 is a perspective view of a turbine blade using a conventional shroud, with the airfoil portion including contour lines to better illustrate the shape of the airfoil.
Figure 2:
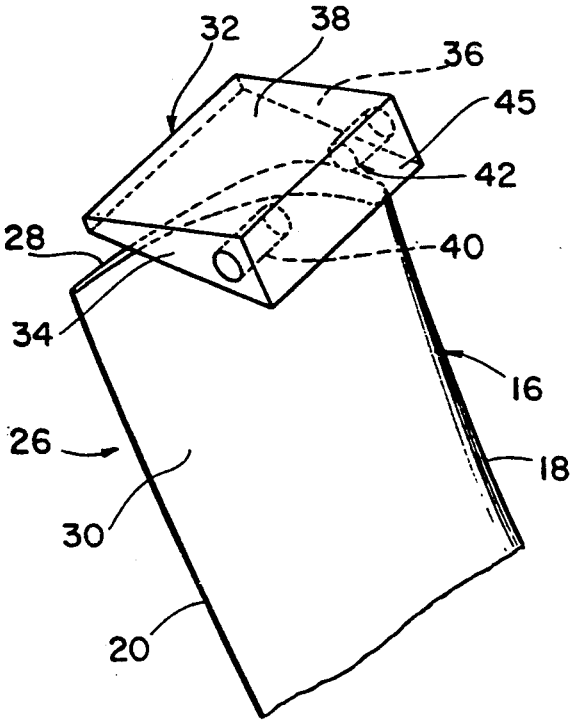
FIG. 2 is a perspective view of a tip portion of a blade according to the present invention.
Figure 2A:
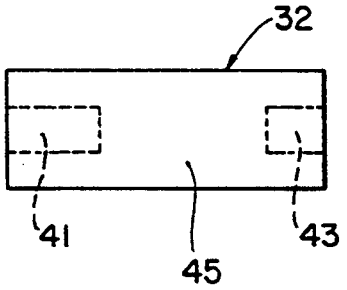

Referring now to FIG. 2, a turbine blade according to the present invention is generally referred to by the numeral 26 and, although only partially illustrated, the blade 26 has the same general construction as the blade 10 illustrated in FIG. 1, in that it has a root portion 12, a platform portion 14 and an airfoil portion 16 extending upwardly from the platform portion and having a leading edge 18 and a trailing edge 20. Between the leading edge 18 and the trailing edge 20 are a convex, suction side surface 28 and a concave pressure-side surface 30.

An integral shroud 32 of the present invention is formed on the tip of the airfoil portion 16 and has two opposite tangential side surfaces 34 and 36, and a top surface 38. A pair of holes 40 and 42 are drilled in the tangential side surfaces in the tangential direction. While a single pair of holes is illustrated, additional pairs of holes may be provided to affect the desired control of shroud center of gravity.

Figure 5:
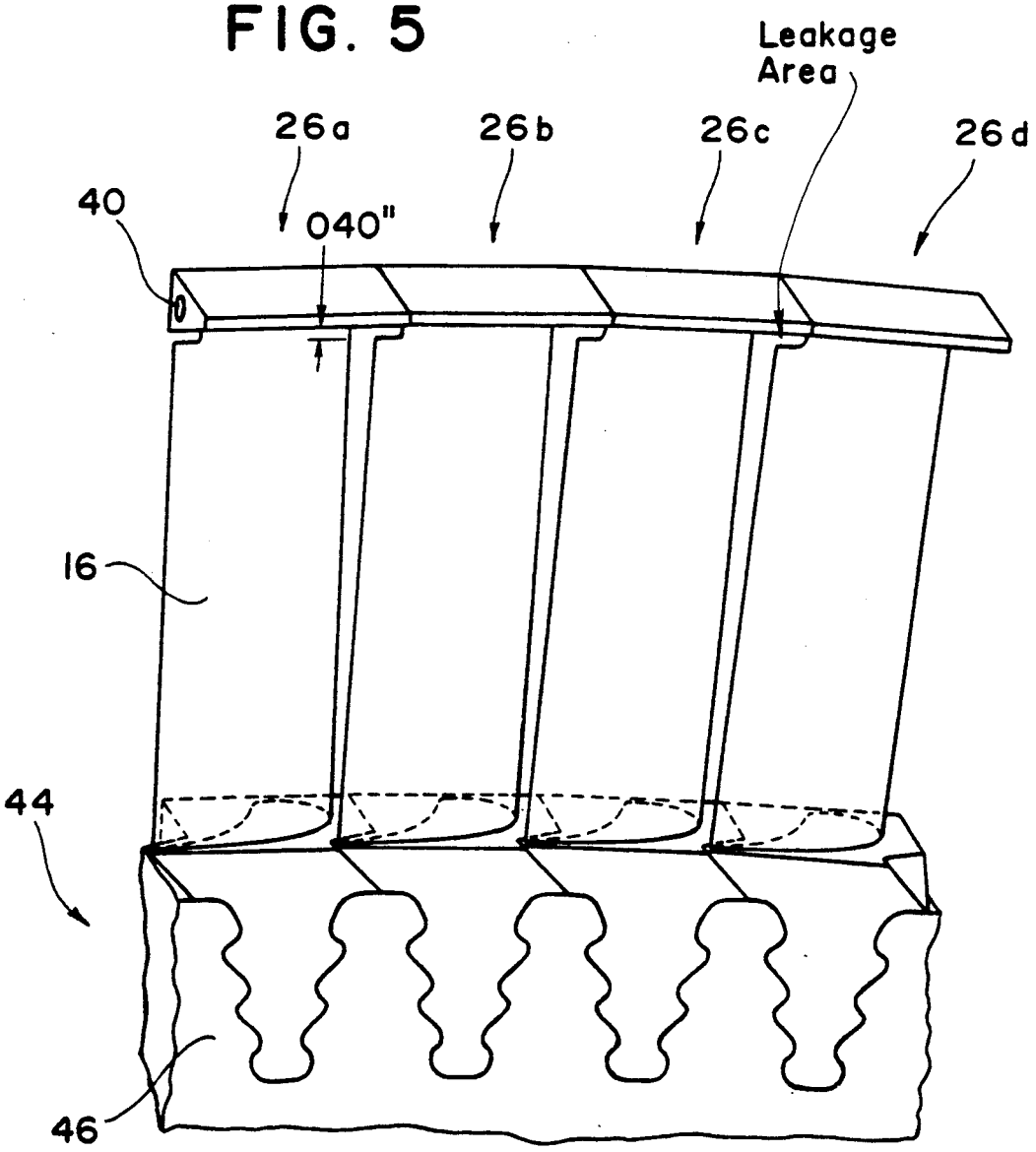
FIG. 5 is a side elevational view showing a portion of a row of integral shroud blades according to the present invention.

The holes may be provided with a different depth so as to create an offset symmetry for the two holes of the pair. In other words, a deeper hole is provided for hole 40 on the concave side of the blade as opposed to the convex side hole 42 which is more shallow. This offset symmetry of the two holes 40 and 42 will allow for reduced trailing edge overhang without increasing root/foil eccentric stresses. Thus, it is possible to minimize the steam leakage path between the airfoil portion outer-diameter trailing edge region and the shroud of the adjacent blade, as shown in FIG. 5. In the design illustrated in FIG. 1, blade/shroud "stacking" above the root portion cannot eliminate the foil protrusion from under the shroud. In FIG. 5, a portion of a blade row 44 of a turbine rotor 46 is illustrated with adjacent blades 26*a*, 26*b*, 26*c*, and 26*d*, with the leakage area illustrated at the outer-diameter trailing edge region. (The "outer-diameter region" refers to the trailing edge at the top of the airfoil portion, closest to the shroud). As shown in FIG. 5, a 0.040 inch (1.016 mm) gap is necessary to prevent assembly interference.

Another feature of the present invention is that the hole depth between adjacent blades can be varied, thus resulting in minor frequency changes between alternate blades. This "mixed tuning" technique will increase shroud snubbing or vibratory impact and hence reduce vibratory stresses. Essentially, the mixed tuning technique of the present invention requires removing a predetermined amount of mass from half the blades of a given row by drilling two holes 40 and 42 of a predetermined depth. The other half of the blades, arranged alternatingly with the other half of blades from the row, will have a different mass which again is a function of the depth of the two holes. As an example, a slight difference in mass for the adjacent blades of the row can result in a frequency change of about 4 Hz, so that half the blades have a frequency of X, and the other half have a frequency of X+4 Hz. The blades are then arranged in an alternating frequency pattern, so as to provide a mixed tuned row. The mixed tuning reduces the probability of blade failure in aerodynamic excitation, such as unstalled flutter (which is a self-excited mechanism wherein a row of blades vibrate at a frequency close to their natural frequency due to aerodynamic negative damping).

The integral shroud blade of the present invention is relatively inexpensive, given that the cost of manufacturing shroud holes will be offset by savings due to the elimination of the shroud lightening groove, and no additional pieces are needed. Moreover, an improved turbine performance due to improved sealing and decreased leakage is likely.

The present invention can also be applied to or be retrofitted on existing designs with shroud lightening grooves. In this case, the benefits of mixed tuning integral shroud blades by slightly varying the mass of the shroud between adjacent blades and/or additional centrifugal force reduction at the foil and root portions will be realized. Reducing the centrifugal force stress even slightly will increase component life in the creep region.

FIG. 2(*a*) is an end view of a shroud 32 showing another embodiment of the present invention whereby a pair of grooves 41 and 43 are formed in the rear surface 45 of the shroud 32. The grooves 41 and 43, being formed in the rear surface 45, do not interfere with the seal contact at the top surface, and thus is similar to the previously described embodiment in that regard. The length of the grooves are selected to be asymmetric as illustrated so as to control the shroud center of gravity in the tangential direction. The width, depth and length of the grooves 41 and 43 also determine the amount of mass which is removed from the shroud. As in the case of the previously described embodiment, the blades of a row can be mixed tuned by varying the amount of mass removal between alternating blades.

Figure 3:
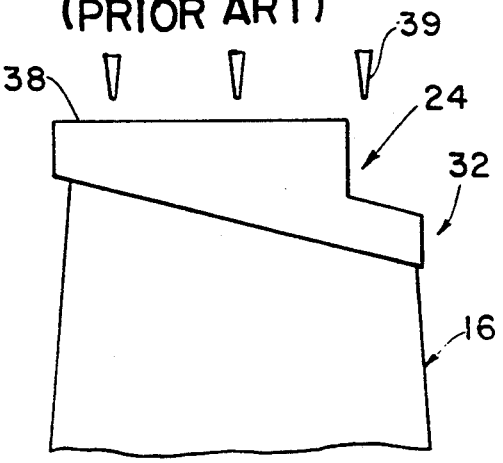
FIG. 3 (PRIOR ART)
FIG. 3 is an enlarged, side elevational view showing an arrangement of the known shroud of FIG. 1 relative to its corresponding seal.
Figure 4:
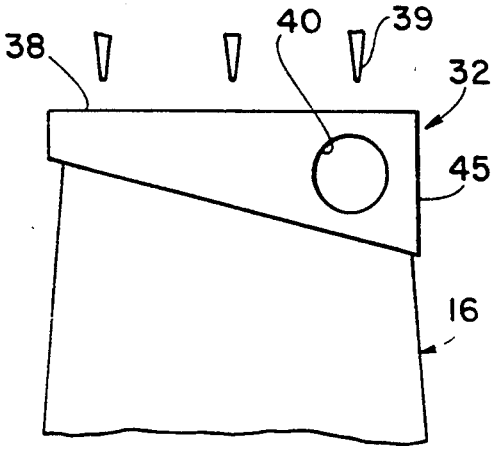
FIG. 4 is an enlarged side elevational view of the integral shroud blade according to the present invention in relation to its corresponding seal.

In both embodiments of the present invention, the top surface 38 of the shroud 32 is not diminished, as shown in FIG. 3, so that the seals 39 of the cylinder provide a better seal with the shroud, as shown in FIG. 4.

Numerous modifications and adaptations of the present invention will be apparent to those so skilled in the art and thus, it is intended by the following claims to cover all such modifications and adaptations which fall within the true spirit and scope of the invention.

What is claimed is:

1. An integral shroud blade comprising:

a root portion for mounting the blade in a row on a turbine rotor;

a platform portion;

an airfoil portion extending upwardly from the platform portion and having a leading edge, a trailing edge, and a tip;

a shroud formed on the tip of the airfoil position and having two opposite tangential side surfaces and a top surface; and at least one pair of holes extending into the shroud through the tangential sides thereof, one of the holes being formed in one of the tangential sides and the other of the holes being formed in the other of the tangential sides, and wherein the holes of each pair of holes are coaxial and each hole has a different depth from the other hole of each pair.

2. An integral shroud blade as recited in claim 1, wherein the airfoil portion has a convex side surface and a concave side surface, and wherein one of the two opposite tangential side surfaces of the shroud overlies the convex surface of the airfoil portion and the other of the two opposite tangential side surfaces overlies the concave side surface of the airfoil portion, and wherein the hole of each pair of holes formed in the tangential side of the shroud which overlies the concave side surface of the airfoil portion has a depth greater than that of the other hole of each pair of holes which is formed in the tangential side surface which overlies the convex side surface of the airfoil portion.

3. An integral shroud blade as recited in claim 1, wherein a center of gravity of the shroud is disposed above a centroid of the root portion so as to minimize eccentric stresses during blade rotation, and the shroud is centered in a tangential direction of the blade.

4. An integral shroud blade comprising:

a root portion for mounting the blade in a row on a turbine rotor;

a platform portion;

an airfoil portion extending upwardly from the platform portion and having a leading edge, a trailing edge, and a tip;

a shroud formed on the tip of the airfoil portion and having two opposite tangential side surfaces, a top surface and a rear surface, the rear surface of the shroud substantially overlying the leading edge of the airfoil; and at least one pair of grooves, each groove of each pair of grooves being formed in the rear surface of the shroud, each groove extending from one of the two opposite tangential side surfaces towards each other, the two grooves of each pair of grooves having a length and depth which is selected to place the center of gravity of the shroud above a centroid of the root portion.

5. An integral shroud blade as recited in claim 4, wherein one of the grooves of the pair of grooves has a length longer than the other groove of the pair of grooves.

6. A method of tuning shrouded blades mounted in a row on a rotor of a steam turbine, wherein each blade of the row has a root portion for mounting the blade in the row on the turbine rotor, a platform portion, an airfoil portion extending upwardly from the platform portion and having a leading edge, a trailing edge, and a tip, and a shroud formed on the tip of the airfoil portion and having two opposite tangential side surfaces, a top surface and a rear surface, the method comprising the steps of:

forming at least a pair of holes extending into the shroud through the tangential sides thereof, one of the holes being formed in one of the tangential sides and the other of the holes being formed in the other of the tangential sides, and said pair of holes being formed in the shroud of each of the blades of the row; and varying the hole depth between adjacent blades so as to create a minor frequency change for alternating blades of the row.

* * * * *